US009842536B2

(12) United States Patent
Choi

(10) Patent No.: US 9,842,536 B2
(45) Date of Patent: Dec. 12, 2017

(54) DISPLAY PANEL DRIVER AND DISPLAY DEVICE HAVING THE SAME

(71) Applicant: SAMSUNG DISPLAY CO., LTD., Yongin-si, Gyeonggi-Do (KR)

(72) Inventor: Deok-Jun Choi, Cheonan-si (KR)

(73) Assignee: Samsung Display Co., Ltd., Yongin-Si, Gyeonggi-do (KR)

( * ) Notice: Subject to any disclaimer, the term of this patent is extended or adjusted under 35 U.S.C. 154(b) by 255 days.

(21) Appl. No.: 14/837,057

(22) Filed: Aug. 27, 2015

(65) Prior Publication Data

US 2016/0284257 A1 Sep. 29, 2016

(30) Foreign Application Priority Data

Mar. 24, 2015 (KR) ..... 10-2015-0040594

(51) Int. Cl.

| | |
|---|---|
| ***G09G 5/00*** | (2006.01) |
| ***G09G 3/3225*** | (2016.01) |
| ***G09G 3/36*** | (2006.01) |
| ***G09G 3/3275*** | (2016.01) |

(52) U.S. Cl.

CPC ..... *G09G 3/3225* (2013.01); *G09G 3/3275* (2013.01); *G09G 3/3648* (2013.01); *G09G 3/3688* (2013.01); *G09G 2300/0404* (2013.01); *G09G 2300/0452* (2013.01); *G09G 2310/0297* (2013.01); *G09G 2310/08* (2013.01); *G09G 2320/10* (2013.01); *G09G 2330/021* (2013.01); *G09G 2340/0435* (2013.01)

(58) Field of Classification Search

CPC .. G09G 3/3225; G09G 3/3688; G09G 3/3275; G09G 3/3648; G09G 2340/0435; G09G 2310/0297; G09G 2300/0452; G09G 2320/10; G09G 2300/0404; G09G 2310/08; G09G 2330/021

See application file for complete search history.

(56) References Cited

U.S. PATENT DOCUMENTS

| | | | | |
|---|---|---|---|---|
| 2002/0167504 | A1* | 11/2002 | Matsumoto | G09G 3/3688 345/204 |
| 2012/0133635 | A1* | 5/2012 | Ji | G09G 3/3688 345/212 |
| 2013/0241859 | A1* | 9/2013 | Saitoh | G06F 3/041 345/173 |
| 2015/0187334 | A1* | 7/2015 | Oh | G09G 3/2025 345/204 |

FOREIGN PATENT DOCUMENTS

| | | |
|---|---|---|
| KR | 10-1998-0043930 | 9/1998 |
| KR | 10-2007-0068774 A | 7/2007 |
| KR | 10-2007-0102861 A | 10/2007 |
| KR | 10-2013-0037490 A | 4/2013 |

* cited by examiner

*Primary Examiner* — Jonathan Boyd
(74) *Attorney, Agent, or Firm* — Lee & Morse, P.C.

(57) ABSTRACT

A display device includes a data driver, line selectors, and a controller. The data driver provides data signals to output lines. The line selectors control connections between the output lines and data lines. The controller selects a normal driving mode or a low frequency driving mode as a panel driving mode and controls a scan driver, the data driver, and the line selectors based on the panel driving mode. Each line selector respectively connects the output lines to the data lines when the panel driving mode is the normal driving mode, and progressively connects one of the output lines to some of the data lines when the panel driving mode is the low frequency driving mode.

20 Claims, 10 Drawing Sheets

DISPLAY PANEL DRIVER AND DISPLAY DEVICE HAVING THE SAME

CROSS REFERENCE TO RELATED APPLICATION

Korean Patent Application No. 10-2015-0040594, filed on Mar. 24, 2015, and entitled, "Display Panel Driver and Display Device Having The Same," is incorporated by reference herein in its entirety.

BACKGROUND

1. Field

One or more embodiments described herein relate to a display panel driver and a display device having a display panel driver.

2. Description of the Related Art

A variety of flat panel displays have been developed. Examples include liquid crystal displays, plasma displays, and organic light emitting displays. These displays are controlled by a scan driver, a data driver, and a controller. The driver may drive the display panel at a high frequency to improve display quality or at a low frequency to reduce power consumption.

SUMMARY

In accordance with one or more embodiments, a display device includes a display panel including scan lines, data lines, and pixels; a scan driver to provide scan signals to the scan lines; a data driver to provide data signals to output lines; a plurality of line selectors to control connections between the output lines and the data lines; and a controller to select a normal driving mode or a low frequency driving mode as a panel driving mode for driving the display panel, and to control the scan driver, the data driver, and the line selectors based on the panel driving mode, wherein each of the line selectors is to respectively connect the output lines to the data lines when the panel driving mode is the normal driving mode and is to progressively connect one of the output lines to some of the data lines when the panel driving mode is the low frequency driving mode.

The data driver may output the data signals through regular output terminals and selective output terminals when the panel driving mode is the normal driving mode, and may output the data signals through the regular output terminals when the panel driving mode is the low frequency driving mode.

A (K)th line selector of the line selectors may include a (2K−1)th transistor connected between a (K)th regular output terminal of the regular output terminals and a (2K−1)th data line of the data lines and to turn on based on a first selection control signal; and a (2K)th transistor connected between the (K)th regular output terminal and a (2K)th data line of the data lines and to turn on based on a second selection control signal.

The controller may apply the first selection control signal to the line selectors and is not to apply the second selection control signal to the line selectors when the panel driving mode is the normal driving mode. The controller may progressively apply the first selection control signal and the second selection signal to the line selectors in every horizontal period when the panel driving mode is the low frequency driving mode.

The display panel may include a first pixel column connected to the (2K−1)th data line and including red color pixels and blue color pixels alternately arranged; and a second pixel column connected to the (2K)th data line and including green color pixels. A (K)th line selector of the line selectors may include a (3K−2)th transistor connected between a (K)th regular output terminal of the regular output terminals and a (3K−2)th data line of the data lines and to turn on based on a first selection control signal; a (3K−1)th transistor connected between the (K)th regular output terminal and a (3K−1)th data line of the data lines and to turn on based on a second selection control signal; and a (3K)th transistor connected between the (K)th regular output terminal and a (3K)th data line of the data lines and to turn on based on a third selection control signal.

The controller may apply the first selection control signal to the line selectors and is not to apply the second selection control signal and the third selection control signal to the line selectors when the panel driving mode is the normal driving mode. The controller may progressively apply the first selection control signal, the second selection signal, and the third selection signal to the line selectors in every horizontal period when the panel driving mode is the low frequency driving mode.

The display panel may include a first pixel column connected to the (3K−2)th data line and including column red color pixels; a second pixel column connected to the (3K−1)th data line and including green color pixels; and a third pixel column connected to the (3K)th data line and including blue color pixels. The controller may receive a driving frequency information and select the panel driving mode based on the driving frequency information. The controller may select the panel driving mode based on image data.

The controller may include a still image determiner to determine whether the image data are still image data; a driving mode selector to select the low frequency driving mode as the panel driving mode when the image data are the still image data and to select the normal driving mode as the panel driving mode when the image data are moving image data; and a control signal generator to generate a control signal corresponding to the selected panel driving mode to control the scan driver, data driver, and the line selectors. The control signal generator may generate the control signal with a first frequency in the low frequency driving mode and may generate the control signal with a second frequency substantially two times larger than the first frequency in the normal driving mode.

In accordance with one or more other embodiments, a display panel driver includes a data driver to provide data signals to output lines; a plurality of line selectors to control connections between the output lines and data lines; and a controller to select a normal driving mode or a low frequency driving mode as a panel driving mode for driving a display panel and to control the data driver and the line selectors based on the panel driving mode, wherein each of the line selectors is to respectively connect the output lines to the data lines when the panel driving mode is the normal driving mode and is to progressively connect one of the output lines to some of the data lines when the panel driving mode is the low frequency driving mode.

The data driver may output the data signals through regular output terminals and selective output terminals when the panel driving mode is the normal driving mode, and to output the data signals through regular output terminals when the panel driving mode is the low frequency driving mode.

A (K)th line selector of the line selectors may include a (2K−1)th transistor connected between a (K)th regular output terminal of the regular output terminals and a (2K−1)th data line of the data lines and to turn on based on a first selection control signal; and a (2K)th transistor connected between the (K)th regular output terminal and a (2K)th data line of the data lines and to turn on based on a second selection control signal.

The controller may receive driving frequency information and to select the panel driving mode corresponding to the driving frequency information. The controller may select the panel driving mode based on image data. The controller may include a still image determiner to determine whether the image data are still image data; a driving mode selector to select the low frequency driving mode as the panel driving mode when the image data are the still image data and to select the normal driving mode as the panel driving mode when the image data are moving image data; and a control signal generator to generate a control signal corresponding to the selected panel driving mode to control the scan driver, the data driver, and the line selectors.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
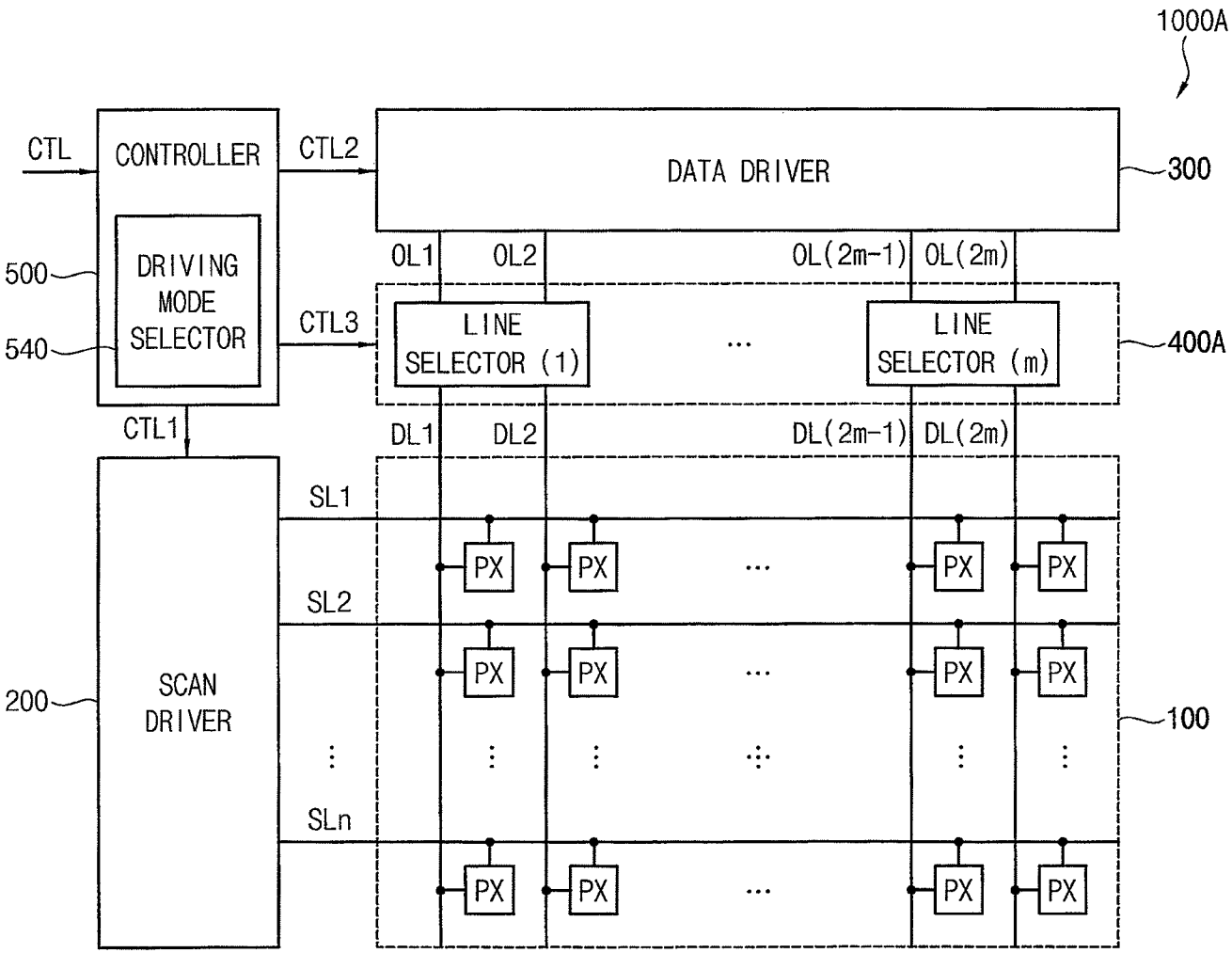
FIG. 1 illustrates an embodiment of a display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments. Like reference numerals refer to like elements throughout.

FIG. 1 illustrates an embodiment of a display device 1000A which includes a display panel 100, a scan driver 200, a data driver 300, a plurality of line selectors 400A, and a controller 500. The display panel 100 includes a plurality of scan lines SL1 through SLn, a plurality of data lines DL1 through DL(2*m*), and a plurality of pixels PX. For example, the display panel 100 may include n*2*m* pixels PX arranged at crossing points of the scan lines SL1 through SLn and the data lines DL1 through DL(2*m*).

The scan driver 200 provides scan signals to the scan lines SL1 through SLn. The scan driver 200 may progressively apply the scan signals to the scan lines SL1 through SLn based on a first control signal CTL1 provided from the controller 500.

The data driver 300 provides data signals to a plurality of output lines OL1 through OL(2*m*). The data driver 300 converts image data to the data signals and outputs the data signals to the output lines OL1 through OL(2*m*) based on a second control signal CTL2 from the controller 500. In one example embodiment, the data driver 300 may output the data signals through a plurality of regular output terminals and a plurality of selective output terminals when the panel driving mode is the normal driving mode. Also, the data driver 300 may output the data signals through the regular output terminals when the panel driving mode is the low frequency driving mode.

The line selectors 400A may control a connection between the output lines OL1 through OL(2*m*) and the data lines DL1 through DL(2*m*). Each line selector may respectively connect the output lines OL1 through OL(2*m*) to the data lines DL1 through DL(2*m*) when the panel driving mode is the normal driving mode. Also, each line selector may progressively connect one of the output lines (e.g., OL1) to some of the data lines (e.g., DL1 and DL2) when the panel driving mode is the low frequency driving mode. Thus, in the normal driving mode, each line selector may control a connection between the output lines OL1 through OL(2*m*) and the data lines DL1 through DL(2*m*) such that the output lines OL1 through OL(2*m*) are respectively connected to the data lines DL1 through DL(2*m*), e.g., one to one correspondence.

For example, the first line selector may connect a first output line OL1 to a first data line DL1 and connect a second output line OL2 to a second data line DL2 in the normal driving mode. Also, in the low frequency driving mode, each line selector may control the connection between the output lines OL1 through OL(2*m*) and the data lines DL1 through DL(2*m*), such that the output line in which the data signal is applied (e.g. output line connected to the regular output terminal) is progressively connected to some of the data lines. For example, in the low frequency driving mode, the first line selector may progressively connect the first output line OL1 to the first data line DL1 and the second data line DL2 in every horizontal period.

The controller 500 includes a driving mode selector 540 that selects the normal driving mode or the low frequency driving mode as a panel driving mode for driving the display panel 100. The display device 1000A may be driven with relatively high frequency in the normal driving mode. Also, the display device 1000A may be driven with relatively low frequency in the low frequency driving mode. The controller 500 may select the normal driving mode or the low frequency driving mode as the panel driving mode, thereby efficiently driving the display panel 100.

In one example embodiment, the controller 500 may receive driving frequency information from an external source and select the panel driving mode corresponding to the driving frequency information. For example, when the display device 1000A is in a standby status or a power saving status, an application processor (AP) may provide the driving frequency information corresponding to the low frequency driving mode to the controller 500. The controller 500 may select the low frequency driving mode as the panel driving mode corresponding to the driving frequency information from the AP. In another example embodiment, the controller 500 may select the panel driving mode based on image data. For example, when the image data are still image data, the controller 500 may select the low frequency driving mode as the panel driving mode.

The controller 500 may control the scan driver 200, the data driver 300, and the line selectors 400A based on the panel driving mode. The controller 500 may generate control signals CTL1 through CTL3 to control the scan driver 200, the data driver 300, and the line selectors 400A.

Figure 2:
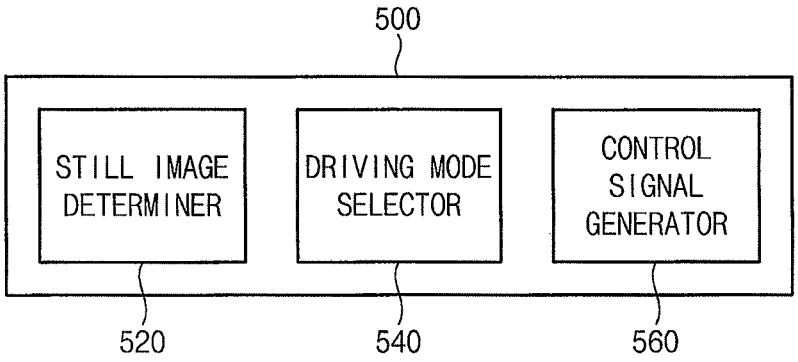
FIG. 2 illustrates an embodiment of a controller.

FIG. 2 illustrates an embodiment of a controller of the display device 1000A in FIG. 1. Referring to FIG. 2, the controller 500 includes a still image determiner 520, a driving mode selector 540, and a control signal generator 560.

The still image determiner 520 determines whether the image data are still image data. For example, the still image determiner 520 may analyze the image data to check whether frame data are changed during predetermined frame period. The still image determiner 520 may determine that the image data are the still image data when the frame data are not changed during the predetermined frame period. The still image determiner 520 may determine that the image data are the moving image data when the frame data are changed during the predetermined frame period. When the image data are the still image data, the still image determiner 520 output a still image flag to notify that the image data are the still image data.

The driving mode selector 540 selects a normal driving mode or a low frequency driving mode as a panel driving mode. In one example embodiment, the driving mode selector 540 may select the low frequency driving mode as the panel driving mode when the image data are the still image data. Also, the driving mode selector may select the normal driving mode as the panel driving mode when the image data are moving image data. Thus. when the image data are the still image data, the driving mode selector 540 may select the low frequency driving mode as the panel driving mode to reduce power consumption. Also, when the image data are not the still image data (e.g., the moving image data), the driving mode selector 540 may select the normal driving mode as the panel driving mode to secure a charging time for charging the data signal and improve the display quality. In another example embodiment, the driving mode selector 540 may receive driving frequency information from an external source (e.g., AP) and select the panel driving mode.

The control signal generator 560 generates a control signal corresponding to the selected panel driving mode to control the scan driver, the data driver, and the line selectors. For example, the control signal generator 560 may provide a second control signal to the data driver to output the data signals corresponding to the panel driving mode. The control signal generator 560 may provide the third control signal to the line selectors to select the data lines corresponding to the panel driving mode. In one example embodiment, the control signal generator 560 may generate the control signals with a first frequency in the low frequency driving mode and may generate the control signals with a second frequency greater (e.g., about two times larger) than the first frequency in the normal driving mode. Therefore, in the low frequency driving mode, the display device is controlled using the control signals with the first frequency, thereby reducing power consumption. In the normal driving mode, the display device is controlled using the control signals with the second frequency, thereby securing charging time.

Figure 3:
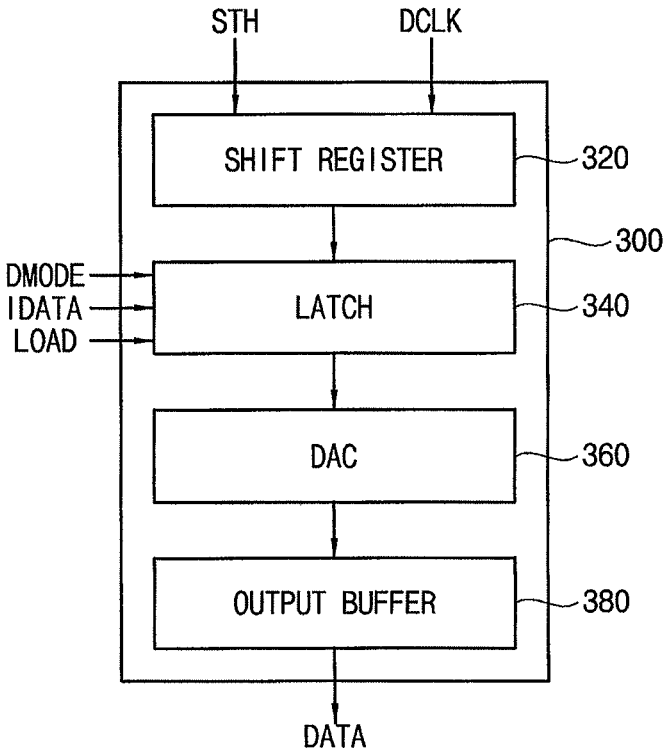
FIG. 3 illustrates an embodiment of a data driver.

FIG. 3 illustrates an embodiment of the data driver 300 which includes a shift register 320, a latch circuit 340, a digital-analog converter 360, and an output buffer 380. The shift register 320 receives a horizontal start signal STH and a data clock signal DCLK. The shift register 320 shifts the horizontal start signal STH synchronizing the data clock signal DCLK to generate a sampling signal.

The latch circuit 340 latches input data IDATA based on the driving mode signal DMODE and outputs the latched input data. For example, when the driving mode signal DMODE corresponds to the low frequency driving mode, the latch circuit 340 may latch input data IDATA based on the sampling signal and may output the latched input data based on a load signal LOAD so that the data signals are output through regular output terminals.

The digital-analog converter 360 converts the input data to data signals of an analog-type based on the gamma reference voltages.

The output buffer 380 outputs the converted data signals DATA to the output lines. When the panel driving mode is the normal driving mode, the output buffer 380 outputs the data signals DATA through regular output terminals and selective output terminals. When the panel driving mode is the low frequency driving mode, the output buffer 380 outputs the data signals DATA through the regular output terminals only. Therefore, the output buffer 380 may perform a control operation so that current does not flow through amplifiers connected to the selective output terminals in the low frequency driving mode, thereby reducing power consumption.

Figure 4A:
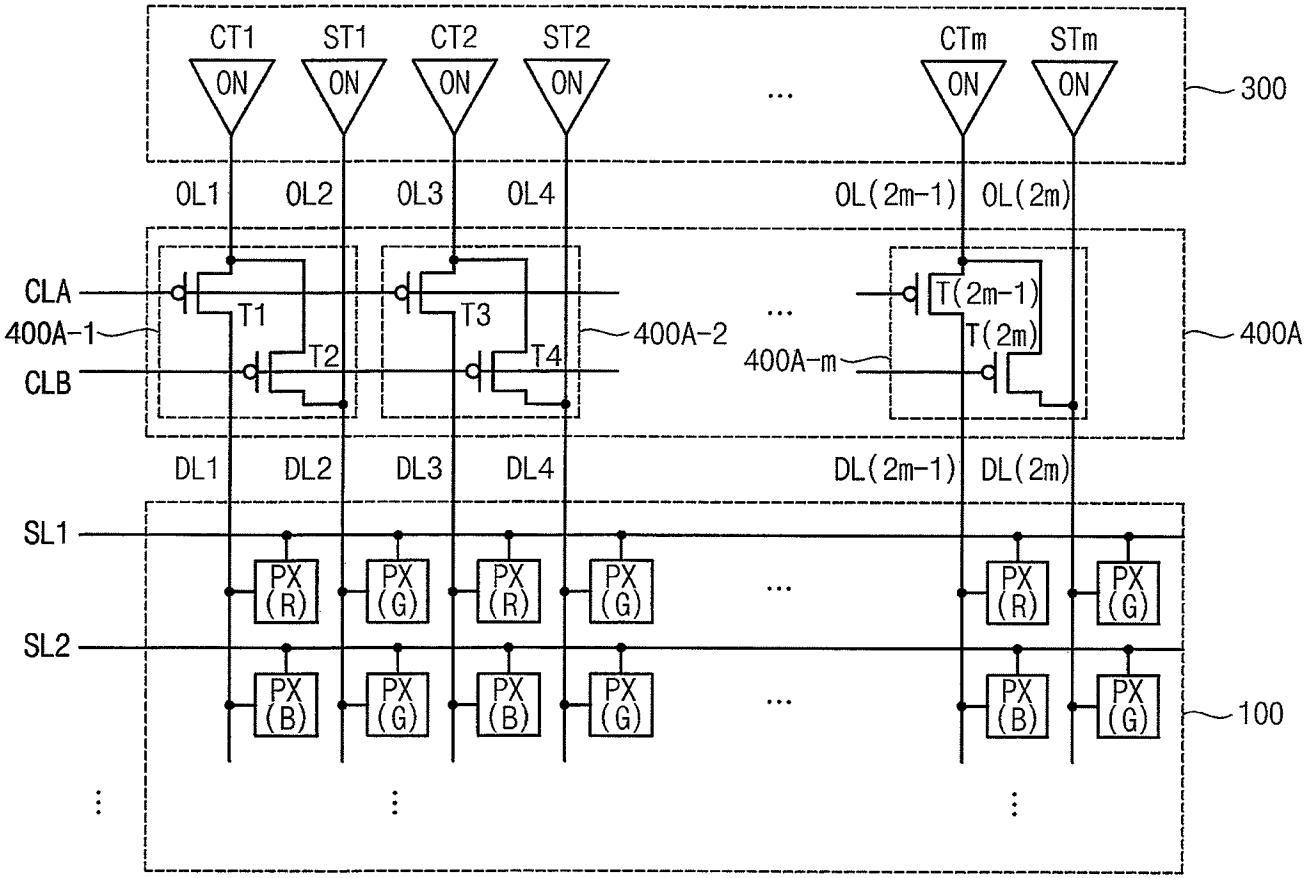
FIGS. 4A and 4B illustrate examples of operations of a display panel driver.
Figure 4B:
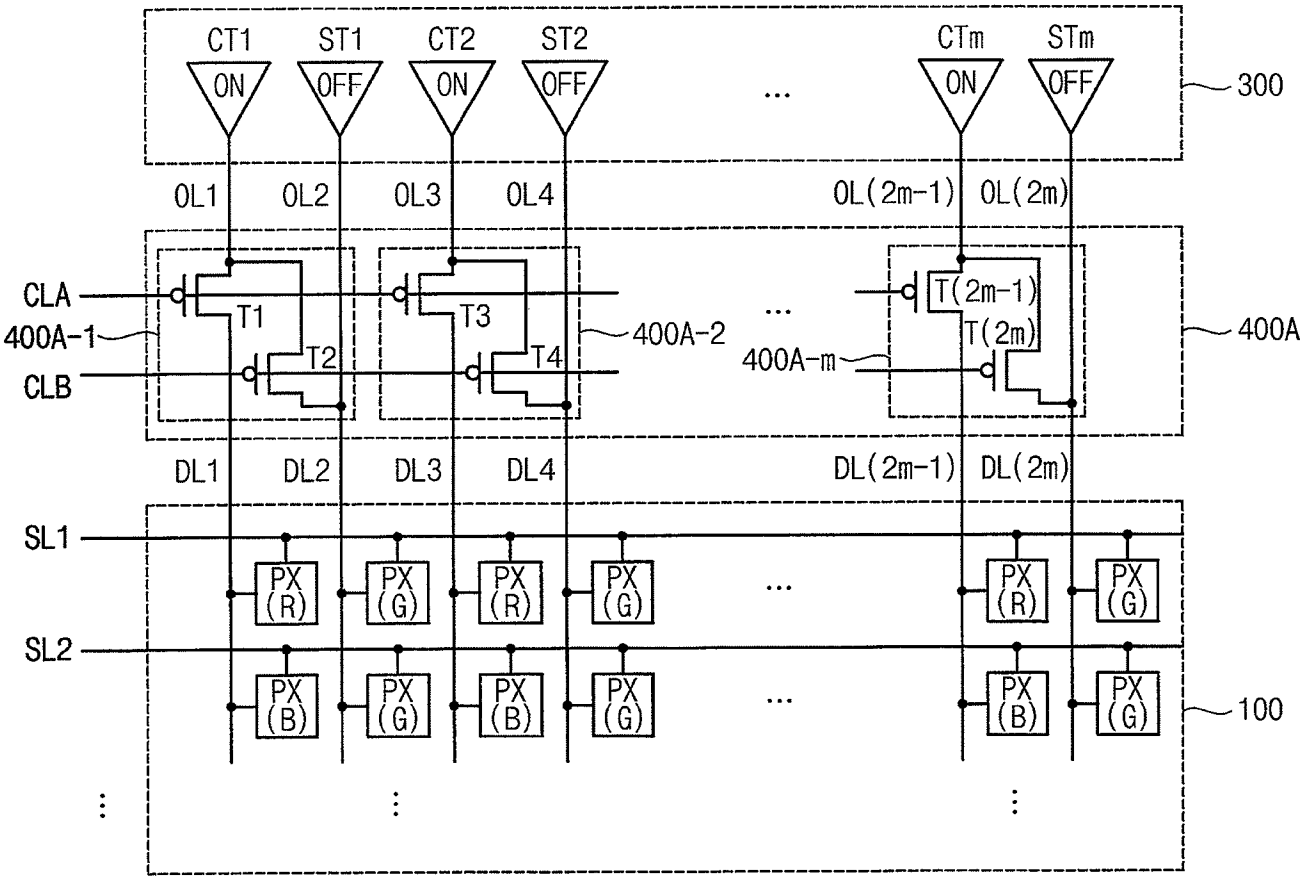

FIGS. 4A and 4B illustrate example for describing operations of the display panel driver in the display device of FIG. 1. Referring to FIGS. 4A and 4B, the line selectors 400A control a connection between the output lines OL1 through OL(2*m*) and the data lines DL1 through DL(2*m*). Each line selector controls a connection between two output lines and two data lines.

The line selectors 400A includes a first line selector 400A-1 through a (M)th line selector 400A-m, where M is an integer greater than 1. A (K)th line selector includes a (2K−1)th transistor and a (2K)th transistor, where K is an integer between 1 and M. The (2K−1)th transistor is connected between a (K)th regular output terminal and a (2K−1)th data line. The (2K−1)th transistor is turned on based on a first selection control signal CLA. The (2K)th transistor is connected between the (K)th regular output terminal and a (2K)th data line. The (2K)th transistor is turned on based on a second selection control signal CLB.

As shown in FIG. 4A, when the panel driving mode is the normal driving mode, the data driver 300 provides the data signals to all output lines OL1 through OL(2*m*) through the regular output terminals CT1 through CTm and selective output terminals ST1 through STm. The controller may apply the first selection control signal CLA to the line selectors 400A and may not apply the second selection control signal CLB to the line selectors 400A. The line selectors 400A control a connection between the output lines OL1 through OL(2*m*) and the data lines DL1 through DL(2*m*), such that the output lines OL1 through OL(2*m*) are respectively connected to the data lines DL1 through DL(2*m*), e.g., one to one correspondence. For example, the first line selector 400A-1 may connect the first output line OL1 to the first data line DL1 and connect the second output line OL2 to the second data line DL2 in the normal driving mode. Therefore, a data signal corresponding to one data line is applied to one output line in every horizontal period, thereby securing the charging time.

As shown in FIG. 4B, when the panel driving mode is the low frequency driving mode, the data driver 300 provides the data signals to some of output lines through the regular output terminals CT1 through CTm. In this case, current may not flow through amplifiers connected to the selective output terminals ST1 through STm. For example, the data driver 300 may provide the data signals to odd number output lines OL1, OL3, . . . connected to the regular output terminals CT1 through CTm. The controller may progressively apply the first selection control signal CLA and the second selection control signal CLB to the line selectors 400A in every horizontal period. Each line selector may progressively connect one output line that is connected to the regular output terminal to two data lines. For example, the first line selector 400A-1 may progressively connect the first output line OL1 to the first data line DL1 and the second data line DL2.

In one example embodiment, the display panel 100 may include a first pixel column and a second pixel column. The first pixel column may be connected to the (2K−1)th data line. Red color pixels and blue color pixels may be alternately arranged in the first pixel column. The second pixel column may be connected to the (2K)th data line. Green color pixels may be arranged in the second pixel column. Thus, the display panel 100 may include the pixels arranged in a pentile-type structure. The display panel 100 having the pentile-type structure may reduce the number of the red color pixels and the blue color pixels by half in comparison with the display panel having the stripe-type structure. Therefore, the display panel 100 having the pentile-type structure may reduce the number of total pixels by ⅔ in comparison with the display panel having the stripe-type structure, thereby increasing the opening ratio of the display panel 100.

Figure 5:
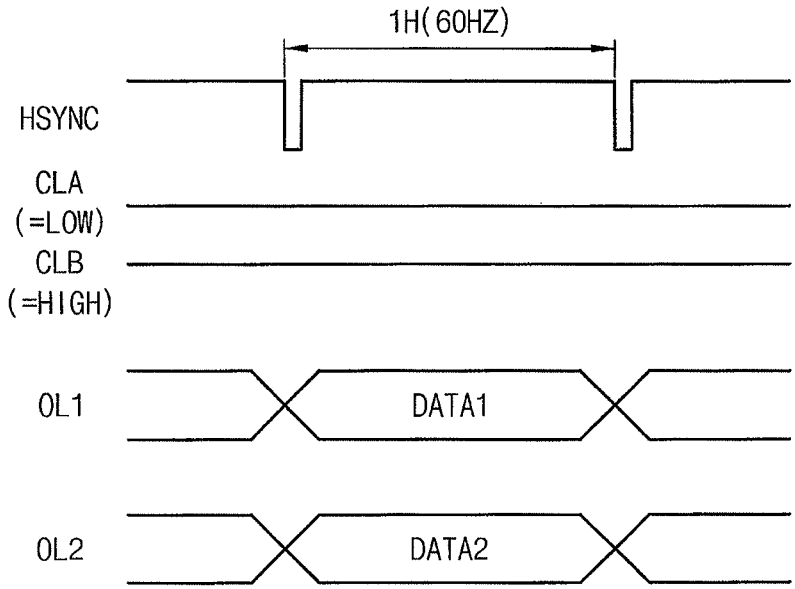
FIG. 5 illustrates an example of control signals for a display device.

FIG. 5 illustrates an example of control signals for the display device 1000A of FIG. 1 in a normal driving mode. Referring to FIG. 5, the display device 1000A may be driven, for example at a 60 Hz frequency in the normal driving mode. In this case, a first time length of one horizontal period is relatively short. In the normal driving mode, the first selection control signal CLA may be applied to the line selectors, and the second selection control signal CLB may not be applied to the line selectors. The first output line may be connected to the first data line, and the second output line may be connected to the second data line. Also, the first data signal DATA1 corresponding to the first data line may be applied to the first output line, and the second data signal DATA2 corresponding to the second data line may be applied to the second output line. Therefore, the output lines are respectively connected to the data lines (e.g., in one to one correspondence), thereby sufficiently securing the charging time.

Figure 6:
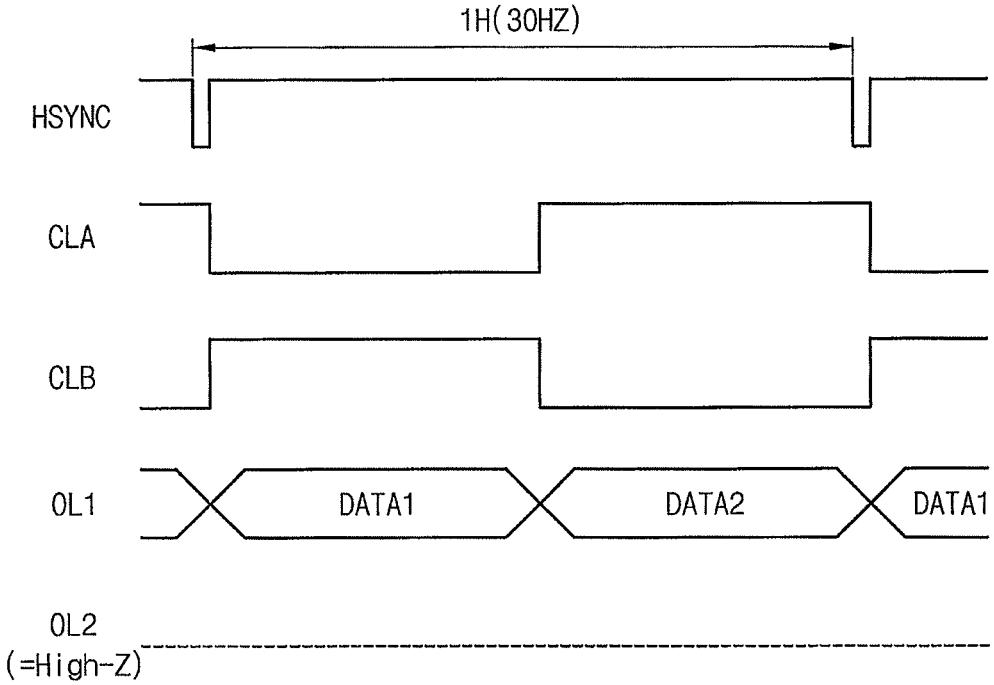
FIG. 6 illustrates another example of control signals for a display device.

FIG. 6 illustrates an example of control signals for the display device 1000A in FIG. 1 in a low frequency driving mode. Referring to FIG. 6, the display device 1000A may be driven, for example, at a 30 Hz frequency in the low frequency driving mode. In this case, a second time length of one horizontal period is relatively long. In the low frequency driving mode, the first selection control signal CLA and the second selection control signal CLB may be progressively applied to the line selectors in every horizontal period. When the first selection control signal CLA is applied to the line selector, the first output line may be connected to the first data line. When the second selection control signal CLB is applied to the line selector, the first output line may be connected to the second data line.

Also, when the first selection control signal CLA is applied to the line selector, the first data signal DATA1 corresponding to the first data line may be applied to the first output line. When the second selection control signal CLB is applied to the line selector, the second data signal DATA2 corresponding to the second data line may be applied to the first output line. Therefore, in the low frequency driving mode, the first output line connected to the regular output terminal is progressively connected to the first and second data lines in every horizontal period, and the first and second data signals are provided to the first and second data lines through the first output line. In this case, the data driver may perform a control operation so that current does not flow through amplifiers connected to the selective output terminals in the low frequency driving mode, thereby reducing power consumption.

Figure 7:
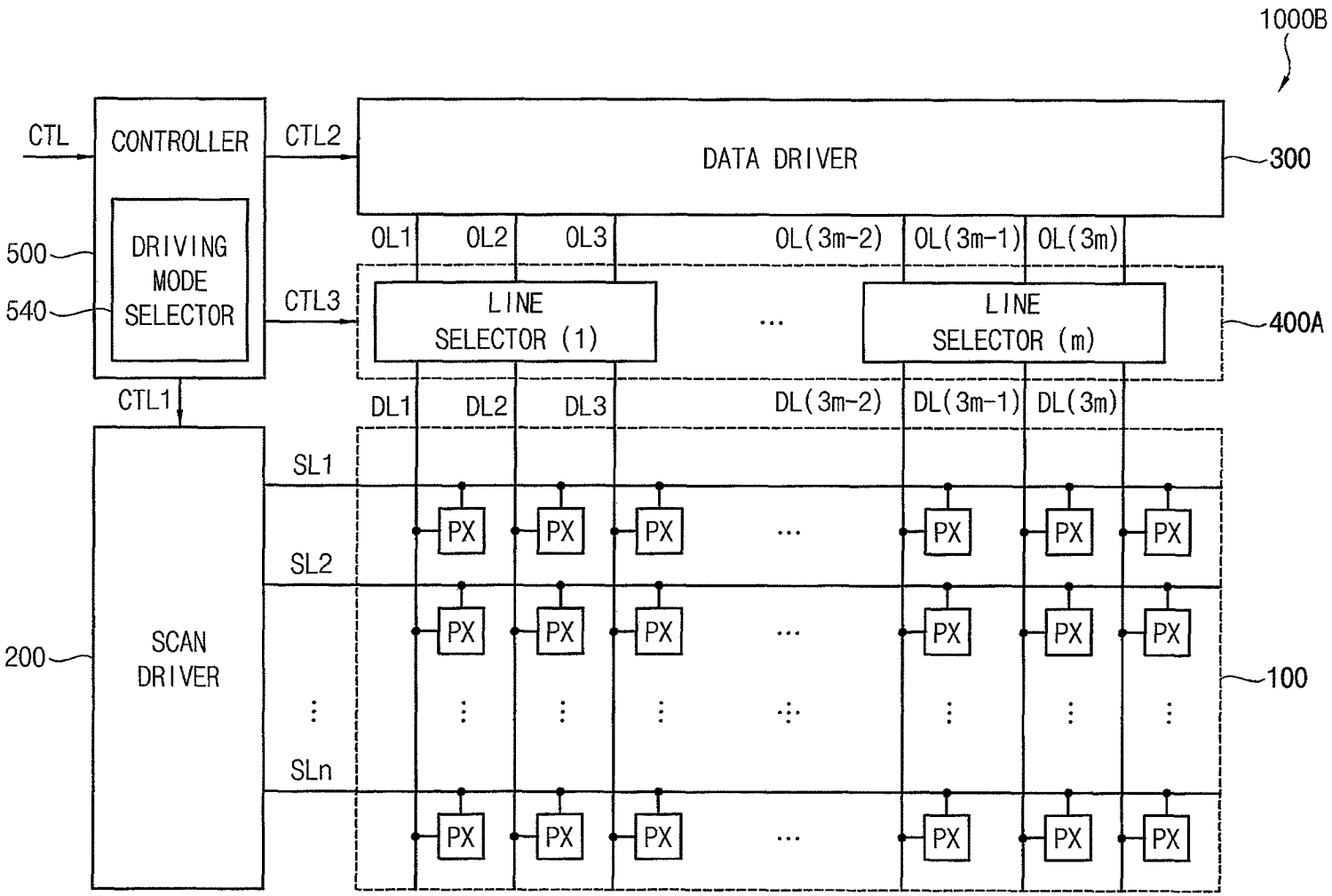
FIG. 7 illustrates another embodiment of a display device.

FIG. 7 illustrates another embodiment of a display device 1000B which includes a display panel 100, a scan driver 200, a data driver 300, a plurality of line selectors 400B, and a controller 500. The display device 1000B is substantially the same as the display device 1000A in FIG. 1, except that each line selector is connected to three output lines and three data lines.

The display panel 100 includes a plurality of scan lines SL1 through SLn, a plurality of data lines DL1 through DL(3*m*), and a plurality of pixels PX. The scan driver 200 provides scan signals to the scan lines SL1 through SLn. The data driver 300 provides data signals to a plurality of output lines OL1 through OL(3*m*).

The line selectors 400B control a connection between the output lines OL1 through OL(3*m*) and the data lines DL1 through DL(3*m*). Each line selector respectively connects the output lines OL1 through OL(3*m*) to the data lines DL1 through DL(3*m*) when the panel driving mode is the normal driving mode. Also, each line selector may progressively connect one of the output lines (e.g., OL1) to some of the data lines (e.g., DL1, DL2, and DL3) when the panel driving mode is the low frequency driving mode. Thus, in the normal driving mode, each line selector control a connection between the output lines OL1 through OL(3*m*) and the data lines DL1 through DL(3*m*), such that the output lines OL1 through OL(3*m*) are respectively connected to the data lines DL1 through DL(3*m*), e.g., in one to one correspondence. For example, the first line selector may connect a first output line OL1 to a first data line DL1, connect a second output line OL2 to a second data line DL2, and connect a third output line OL3 to a third data line DL3 in the normal driving mode.

Also, in the low frequency driving mode, each line selector may control the connection between the output lines OL1 through OL(3*m*) and the data lines DL1 through DL(3*m*), such that the output line in which the data signal is applied (e.g., output line connected to the regular output terminal) is progressively connected to some of the data lines. For example, in the low frequency driving mode, the first line selector may progressively connect the first output line OL1 to the first data line DL1, the second data line DL2, and the third data line DL3 in every horizontal period.

The controller 500 includes a driving mode selector 540 to select the normal driving mode or the low frequency driving mode as a panel driving mode for driving the display panel 100. The controller 500 may control the scan driver 200, the data driver 300, and the line selectors 400B corresponding to the panel driving mode.

Figure 8A:
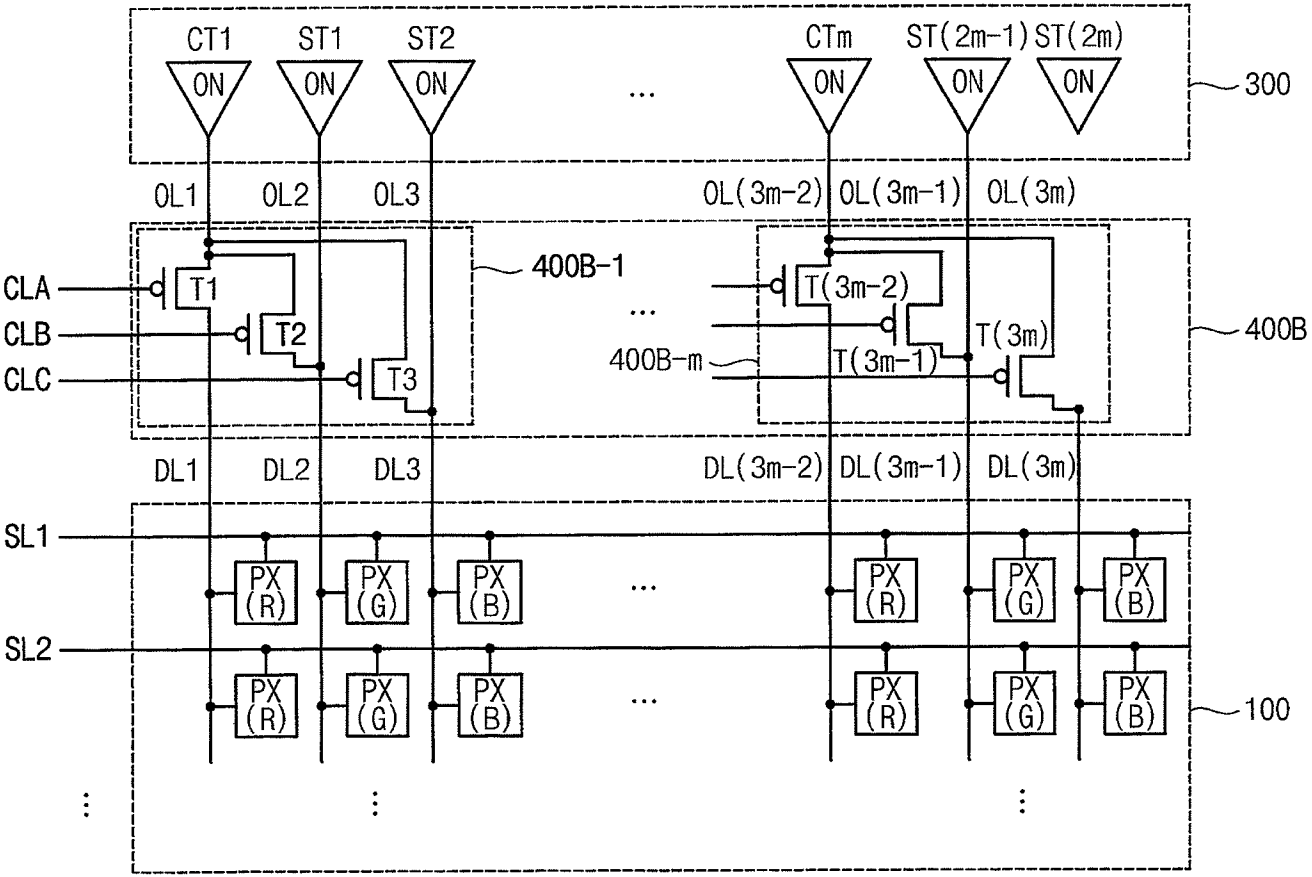
FIGS. 8A and 8B illustrate examples of operations of a display panel driver.
Figure 8B:
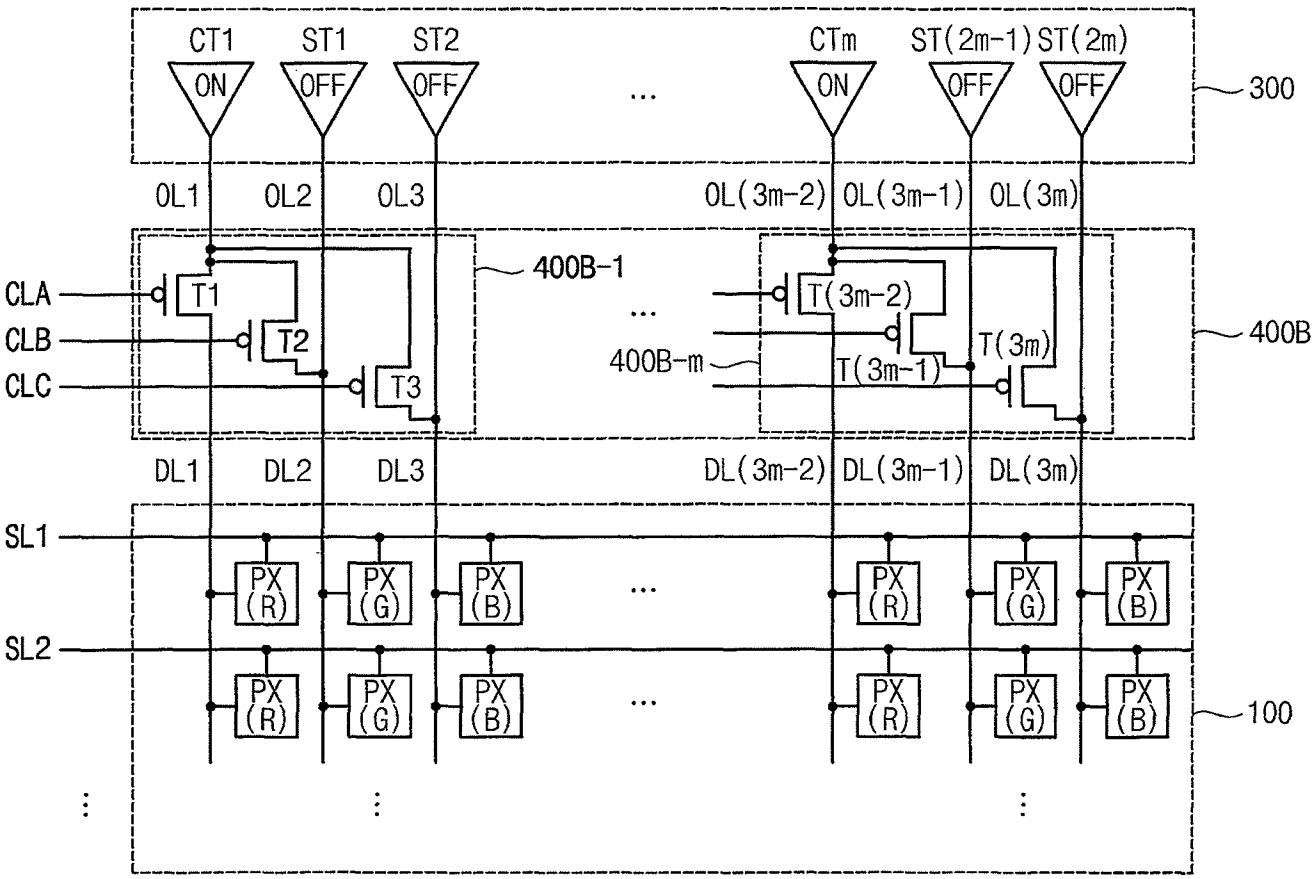

FIGS. 8A and 8B illustrate examples for describing operations of the display panel driver in the display device 1000B in FIG. 7. Referring to FIGS. 8A and 8B, the line selectors 400B control a connection between the output lines OL1 through OL(3*m*) and the data lines DL1 through DL(3*m*). Each line selector may control a connection between three output lines and three data lines.

The line selectors 400B includes a first line selector 400B-1 through a (M)th line selector 400B-m, where M is an integer greater than 1. A (K)th line selector includes a (3K−2)th transistor, a (3K−1)th transistor, and a (3K)th transistor. The (3K−2)th transistor is connected between a (K)th regular output terminal and a (3K−2)th data line. The (3K−2)th transistor is turned on based on a first selection control signal CLA. The (3K−1)th transistor is connected between the (K)th regular output terminal and a (3K−1)th data line. The (3K−1)th transistor is turned on based on a second selection control signal CLB. The (3K)th transistor is connected between the (K)th regular output terminal and a (3K)th data line. The (3K)th transistor is turned on based on a third selection control signal CLC.

As shown in FIG. 8A, when the panel driving mode is the normal driving mode, the data driver 300 provides the data signals to all output lines OL1 through OL(3*m*) through the regular output terminals CT1 through CTm and selective output terminals ST1 through ST(2*m*). The controller applies the first selection control signal CLA to the line selectors 400B and does not apply the second selection control signal CLB and the third selection control signal CLC to the line selectors 400B. The line selectors 400B control a connection between the output lines OL1 through OL(3*m*) and the data lines DL1 through DL(3*m*) such that the output lines OL1 through OL(3*m*) are respectively connected to the data lines DL1 through DL(3*m*), e.g., one to one correspondence.

For example, the first line selector 400B-1 connects the first output line OL1 to the first data line DL1, connects the second output line OL2 to the second data line DL2, and connects the third output line OL3 to the third data line DL3 in the normal driving mode. Therefore, a data signal corresponding to one data line is applied to one output line in every horizontal period, thereby securing the charging time.

As shown in FIG. 8B, when the panel driving mode is the low frequency driving mode, the data driver 300 may provide the data signals to some of output lines through the regular output terminals CT1 through CTm. In this case, a current may do not flow through amplifiers connected to the selective output terminals ST1 through ST(2*m*). For example, the data driver 300 may provide the data signals to the output lines OL1, OL4, . . . connected to the regular output terminals CT1 through CTm. The controller may progressively apply the first selection control signal CLA, the second selection control signal CLB, and the third selection control signal CLC to the line selectors 400B in every horizontal period. Each line selector may progressively connect one output line connected to the regular output terminal to three data lines. For example, the first line selector 400B-1 may progressively connect the first output line OL1 to the first data line DL1, the second data line DL2, and the third data line DL3.

In one example embodiment, the display panel 100 may include a first pixel column, a second pixel column, and a third pixel column. The first pixel column may be connected to the (3K−2)th data line. Red color pixels may be arranged in the first pixel column. The second pixel column may be connected to the (3K−1)th data line. Green color pixels may be arranged in the second pixel column. The third pixel column may be connected to the (3K)th data line. Blue color pixels may be arranged in the third pixel column. Thus, the display panel 100 may include pixels arranged in a stripe-type structure, and the pixels corresponding to one data line may emit one color of light.

Figure 9:
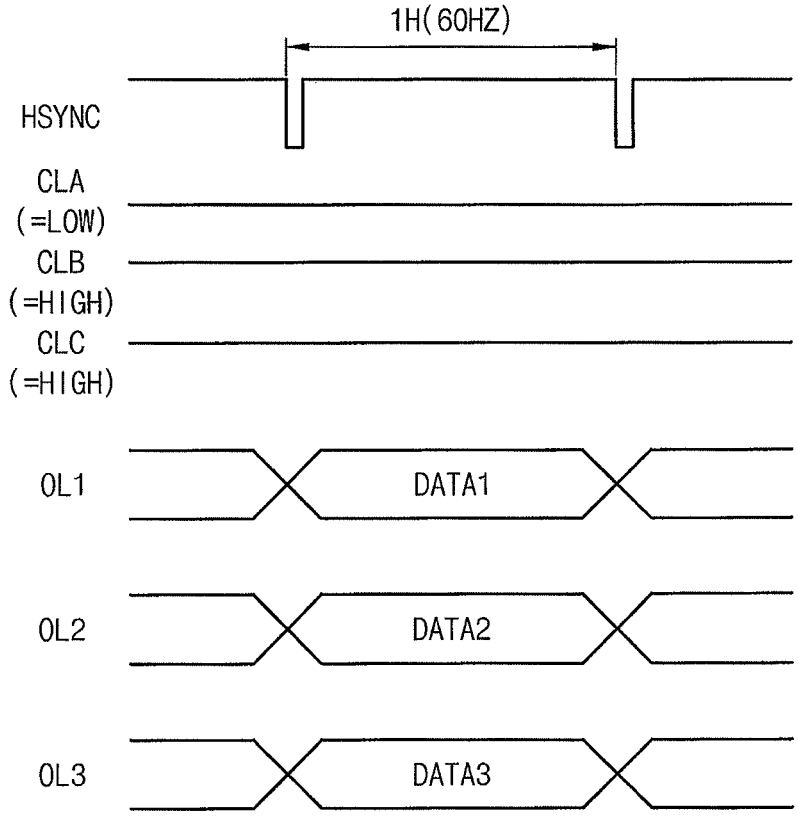
FIG. 9 illustrates an example of control signals for the display device in FIG. 7.

FIG. 9 illustrates an example of control signals for the display device 1000B in FIG. 7 in a normal driving mode. Referring to FIG. 9, the display device may be driven, for example, at a 60 Hz frequency in the normal driving mode. In this case, a first time length of one horizontal period is relatively short. In the normal driving mode, the first selection control signal CLA are applied to the line selectors, and the second selection control signal CLB and the third selection control signal CLC are not applied to the line selectors. The first output line is connected to the first data line, the second output line is connected to the second data line, and the third output line is connected to the third data line. Also, the first data signal DATA1 corresponding to the first data line is applied to the first output line, the second data signal DATA2 corresponding to the second data line is applied to the second output line, and the third data signal DATA3 corresponding to the third data line is applied to the third output line. Therefore, the output lines are respectively connected to the data lines (e.g. om one to one correspondence), thereby sufficiently securing the charging time.

Figure 10:
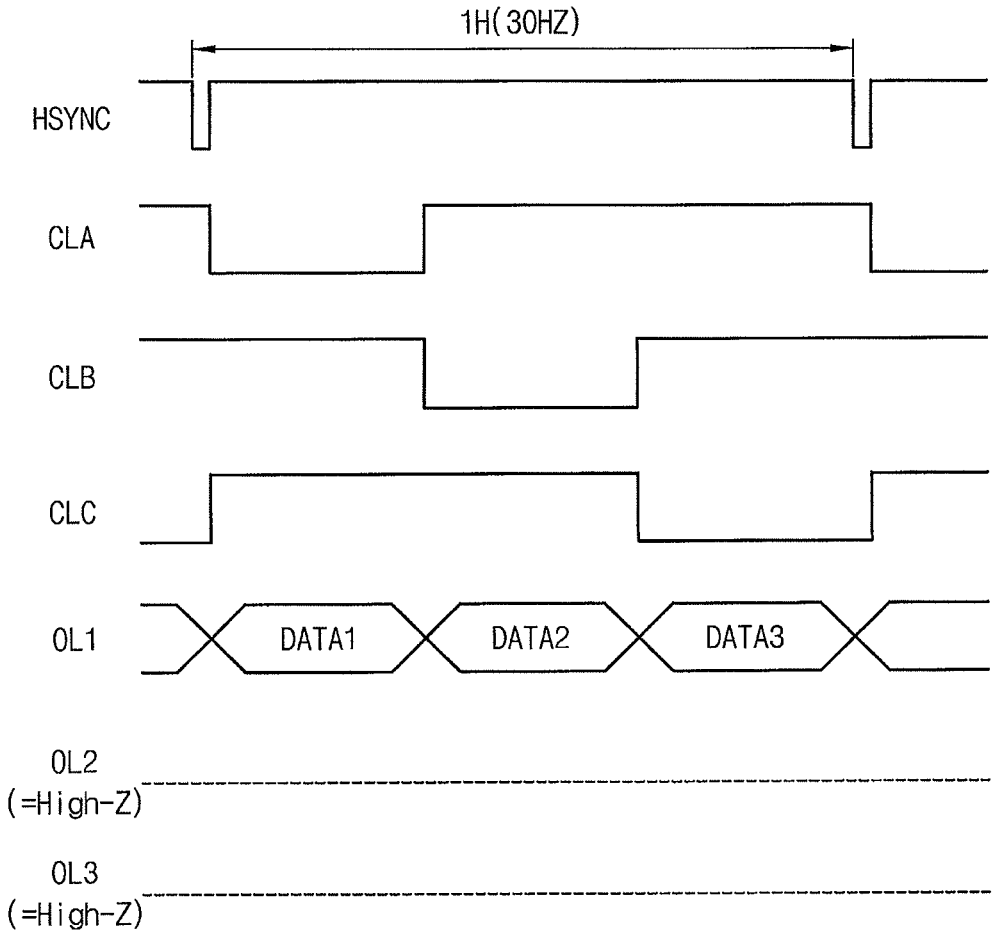
FIG. 10 illustrates another example of control signals for the display device in FIG. 7.

FIG. 10 illustrates an example of control signals for the display device 1000B in FIG. 7 in a low frequency driving mode. Referring to FIG. 10, the display device 1000B may be driven, for example, with a 30 Hz frequency in the low frequency driving mode. In this case, a second time length of one horizontal period is relatively long.

In the low frequency driving mode, the first selection control signal CLA, the second selection control signal CLB, and the third selection control signal CLC may be progressively applied to the line selectors in every horizontal period. When the first selection control signal CLA is applied to the line selector, the first output line is connected to the first data line. When the second selection control signal CLB is applied to the line selector, the first output line is connected to the second data line. When the third selection control signal CLC is applied to the line selector, the first output line is connected to the third data line.

Also, when the first selection control signal CLA is applied to the line selector, the first data signal DATA1 corresponding to the first data line is applied to the first output line. When the second selection control signal CLB is applied to the line selector, the second data signal DATA2 corresponding to the second data line is applied to the first output line. When the third selection control signal CLC is applied to the line selector, the third data signal DATA3 corresponding to the third data line is applied to the first output line.

Therefore, in the low frequency driving mode, the first output line connected to the regular output terminal is progressively connected to the first through third data lines in every horizontal period. and the first through third data signals are provided to the first through third data lines through the first output line. In this case, the data driver perform a control operation such that current does not flow through amplifiers connected to the selective output terminals in the low frequency driving mode, thereby reducing power consumption.

Although the line selector includes p-type metal-oxide semiconductor transistors in the aforementioned embodiments, the line selector may include n-type metal-oxide semiconductor transistors in another embodiment. In addition, each line selector is connected to two or three output lines in the aforementioned embodiments. However, the number of the output lines connected to each line selector may be different in another embodiment, based, for example, on charging time.

The present embodiments may be applied to any type of electronic device having a display device. Examples include a cellular phone, a smart phone, a smart pad, a personal digital assistant (PDA), etc.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controller and other processing features of the embodiments disclosed herein may be implemented in logic which, for example, may include hardware, software, or both. When implemented at least partially in hardware, the controller and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controller and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed. they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A display device, comprising:

a display panel including scan lines, data lines, and pixels;

a scan driver to provide scan signals to the scan lines;

a data driver to provide data signals to output lines;

a plurality of line selectors to control connections between the output lines and the data lines; and a controller to select a normal driving mode or a low frequency driving mode as a panel driving mode for driving the display panel, and to control the scan driver, the data driver, and the line selectors based on the panel driving mode, wherein the line selectors are to respectively connect the output lines to the data lines when the panel driving mode is the normal driving mode and each of the line selectors is to progressively connect one of the output lines to some of the data lines when the panel driving mode is the low frequency driving mode.

2. The display device as claimed in claim 1, wherein the data driver is to:

output the data signals through regular output terminals and selective output terminals when the panel driving mode is the normal driving mode, and output the data signals through the regular output terminals when the panel driving mode is the low frequency driving mode.

3. The display device as claimed in claim 2, wherein a (K)th line selector of the line selectors includes:

a (2K−1)th transistor connected between a (K)th regular output terminal of the regular output terminals and a (2K−1)th data line of the data lines and to turn on based on a first selection control signal; and a (2K)th transistor connected between the (K)th regular output terminal and a (2K)th data line of the data lines and to turn on based on a second selection control signal.

4. The display device as claimed in claim 3, wherein the controller is to apply the first selection control signal to the line selectors and is not to apply the second selection control signal to the line selectors when the panel driving mode is the normal driving mode.

5. The display device as claimed in claim 3, wherein the controller is to progressively apply the first selection control signal and the second selection signal to the line selectors in every horizontal period when the panel driving mode is the low frequency driving mode.

6. The display device as claimed in claim 3, wherein the display panel includes:

a first pixel column connected to the (2K−1)th data line and including red color pixels and blue color pixels alternately arranged; and a second pixel column connected to the (2K)th data line and including green color pixels.

7. The display device as claimed in claim 2, wherein a (K)th line selector of the line selectors includes:

a (3K−2)th transistor connected between a (K)th regular output terminal of the regular output terminals and a (3K−2)th data line of the data lines and to turn on based on a first selection control signal;

a (3K−1)th transistor connected between the (K)th regular output terminal and a (3K−1)th data line of the data lines and to turn on based on a second selection control signal; and a (3K)th transistor connected between the (K)th regular output terminal and a (3K)th data line of the data lines and to turn on based on a third selection control signal.

8. The display device as claimed in claim 7, wherein the controller is to apply the first selection control signal to the line selectors and is not to apply the second selection control signal and the third selection control signal to the line selectors when the panel driving mode is the normal driving mode.

9. The display device as claimed in claim 7, wherein the controller is to progressively apply the first selection control signal, the second selection signal, and the third selection signal to the line selectors in every horizontal period when the panel driving mode is the low frequency driving mode.

10. The display device as claimed in claim 7, wherein the display panel includes:

a first pixel column connected to the (3K−2)th data line and including column red color pixels;

a second pixel column connected to the (3K−1)th data line and including green color pixels; and a third pixel column connected to the (3K)th data line and including blue color pixels.

11. The display device as claimed in claim 1, wherein the controller is to receive a driving frequency information and to select the panel driving mode corresponding to the driving frequency information.

12. The display device as claimed in claim 1, wherein the controller is to select the panel driving mode based on image data.

13. The display device as claimed in claim 12, wherein the controller includes:

a still image determiner to determine whether the image data are still image data;

a driving mode selector to select the low frequency driving mode as the panel driving mode when the image data are the still image data and to select the normal driving mode as the panel driving mode when the image data are moving image data; and a control signal generator to generate a control signal corresponding to the selected panel driving mode to control the scan driver, the data driver, and the line selectors.

14. The display device as claimed in claim 13, wherein the control signal generator is to generate the control signal with a first frequency in the low frequency driving mode and to generate the control signal with a second frequency substantially two times larger than the first frequency in the normal driving mode.

15. A display panel driver, comprising:

a data driver to provide data signals to output lines;

a plurality of line selectors to control connections between the output lines and data lines; and a controller to select a normal driving mode or a low frequency driving mode as a panel driving mode for driving a display panel and to control the data driver and the line selectors based on the panel driving mode, wherein the line selectors are to respectively connect the output lines to the data lines when the panel driving mode is the normal driving mode and each of the line selectors is to progressively connect one of the output lines to some of the data lines when the panel driving mode is the low frequency driving mode.

16. The display panel driver as claimed in claim 15, wherein the data driver is to output the data signals through regular output terminals and selective output terminals when the panel driving mode is the normal driving mode, and to output the data signals through regular output terminals when the panel driving mode is the low frequency driving mode.

17. The display panel driver as claimed in claim 16, wherein a (K)th line selector of the line selectors includes:

a (2K−1)th transistor connected between a (K)th regular output terminal of the regular output terminals and a (2K−1)th data line of the data lines and to turn on based on a first selection control signal; and a (2K)th transistor connected between the (K)th regular output terminal and a (2K)th data line of the data lines and to turn on based on a second selection control signal.

18. The display panel driver as claimed in claim 15, wherein the controller is to receive driving frequency information and to select the panel driving mode corresponding to the driving frequency information.

19. The display panel driver as claimed in claim 15, wherein the controller is to select the panel driving mode based on image data.

20. The display panel driver as claimed in claim 19, wherein the controller includes:

a still image determiner to determine whether the image data are still image data;

a driving mode selector to select the low frequency driving mode as the panel driving mode when the image data are the still image data and to select the normal driving mode as the panel driving mode when the image data are moving image data; and a control signal generator to generate a control signal corresponding to the selected panel driving mode to control a scan driver, the data driver, and the line selectors.

* * * * *